US006655285B2

(12) United States Patent
Nagano et al.

(10) Patent No.: US 6,655,285 B2
(45) Date of Patent: Dec. 2, 2003

(54) METHOD AND DEVICE FOR CONTROLLING AUTOMATIC PRINTING PLATE CHANGING MEANS AND FOLDING DEVICE STATUS SWITCHING DEVICE

(75) Inventors: Hiroyuki Nagano, Higashikatsushika-gun (JP); Tomoo Kaneta, Higashikatsushika-gun (JP)

(73) Assignee: Komori Corporation, Tokyo (JP)

( * ) Notice: Subject to any disclaimer, the term of this patent is extended or adjusted under 35 U.S.C. 154(b) by 0 days.

(21) Appl. No.: 09/851,314

(22) Filed: May 9, 2001

(65) Prior Publication Data

US 2002/0005129 A1 Jan. 17, 2002

(30) Foreign Application Priority Data

May 17, 2000 (JP) ..... 2000-144892

(51) Int. Cl.[7] ..... B41F 33/00; B41F 5/06

(52) U.S. Cl. ..... 101/484; 101/477; 101/480; 101/216

(58) Field of Search ..... 101/477, 479, 101/480, 483, 484, 216, 219, 228

(56) References Cited

U.S. PATENT DOCUMENTS 5,117,753 A * 6/1992 Mamberer ..... 101/225
5,287,805 A * 2/1994 Fischer et al. ..... 101/219
5,595,119 A * 1/1997 Hada et al. ..... 101/477
5,699,735 A * 12/1997 Stein et al. ..... 101/219
5,772,571 A 6/1998 Marcle-Geller et al. .... 493/426
5,983,793 A * 11/1999 Volz et al. ..... 101/216
6,006,662 A * 12/1999 Ishida et al. ..... 101/141
2002/0002917 A1 * 1/2002 Saito ..... 101/348
2002/0002918 A1 * 1/2002 Saito ..... 101/348

FOREIGN PATENT DOCUMENTS

| | | | |
|---|---|---|---|
| DE | 19616629 | A | 11/1997 |
| EP | 0 533 307 | A1 | 3/1993 |
| JP | 63-282053 | A | 11/1988 |
| JP | 2000-130538 | A | 5/2000 |
| WO | 01/68496 | A1 | 9/2001 |

* cited by examiner

*Primary Examiner*—Leslie J. Evanisko
(74) *Attorney, Agent, or Firm*—Birch, Stewart, Kolasch & Birch, LLP

(57) ABSTRACT

A control device has a printing plate changing unit for changing a printing plate supported on a plate cylinder, and a unit for switching a folding device status of a folding machine in accordance with a folding device status in the next printing. The control device operates the printing plate changing unit and the means for switching the folding device status of the folding device simultaneously in order to shorten the total operation time.

17 Claims, 8 Drawing Sheets

METHOD AND DEVICE FOR CONTROLLING AUTOMATIC PRINTING PLATE CHANGING MEANS AND FOLDING DEVICE STATUS SWITCHING DEVICE

The entire disclosure of Japanese Patent Application No. 2000-144892 filed on May 17, 2000 and Japanese Patent Publication No. 2000-130538 published on May 12, 2000 including specification, claims, drawings and summary is incorporated herein by reference in its entirety.

BACKGROUND OF THE INVENTION

1. Field of the Invention

The invention relates to a device for controlling an automatic printing plate changing device and a folding device status switching device, and particularly to a device with a cam mechanism and a guide mechanism wherein an automatic printing plate change (APC) and a folding device status switch are operated simultaneously.

2. Prior Art

In a conventional art, when changing from a previous job to a next job in a web offset printing press, changing of a printing press and switching of a folding status has to be executed in order. Therefore, the entire task takes a long time.

For example, when the previous job is finished, printing units are stopped to clean a blanket cylinder with a blanket. Then, printing plates are exchanged, and further, an old web roll is changed to a new web roll. In order to prepare for the next job, various presetting operations such as an adjustment of an open degree of an ink fountain key in accordance with a picture pattern of a new printing press, a control of a rotational amount of each ink fountain roll, a determination of an amount of supplying dampening water, and a setting of a folding machine are necessary.

In the above described conventional art, when changing from the previous job to the next job, an operator has to operate each device in order. Thus, it takes a long time and a heavy burden is imposed on the operator.

The purpose of the present invention is to resolve the above problems by simultaneously operating the changing of the printing plates and the switching of the folding device status in the folding device.

SUMMARY OF THE INVENTION

To accomplish the above object, a device according to the present invention for controlling an automatic printing plate changing device and a folding device status switching device comprises printing plate changing means for changing a printing plate supported on a plate cylinder, and folding device status switch means for switching folding device status of a folding machine in accordance with the folding device status in the next printing job, wherein the printing plate changing means and the folding device status switching means are operated simultaneously.

To accomplish the above object, the device according to the present invention for controlling an automatic printing plate changing device and a folding device status switching device, further includes means for intermittent travel of a web in the folding device while the printing plate supported on the plate cylinder is being changed.

Based on a first signal from the switch, the ink supplement means reduces the ink amount the basic ink layer thickness distribution, and the web continuous supplement means replaces and connects the web rolls. Based on a second from the switch, the printing plate changing means and the folding device status switching means are activated, and based on a third signal from the switch, the ink supplement means is activated to overlap the ink layer thickness distribution in accordance with the next printing.

DETAILED DESCRIPTION OF THE PREFERRED EMBODIMENT

Figure 1:
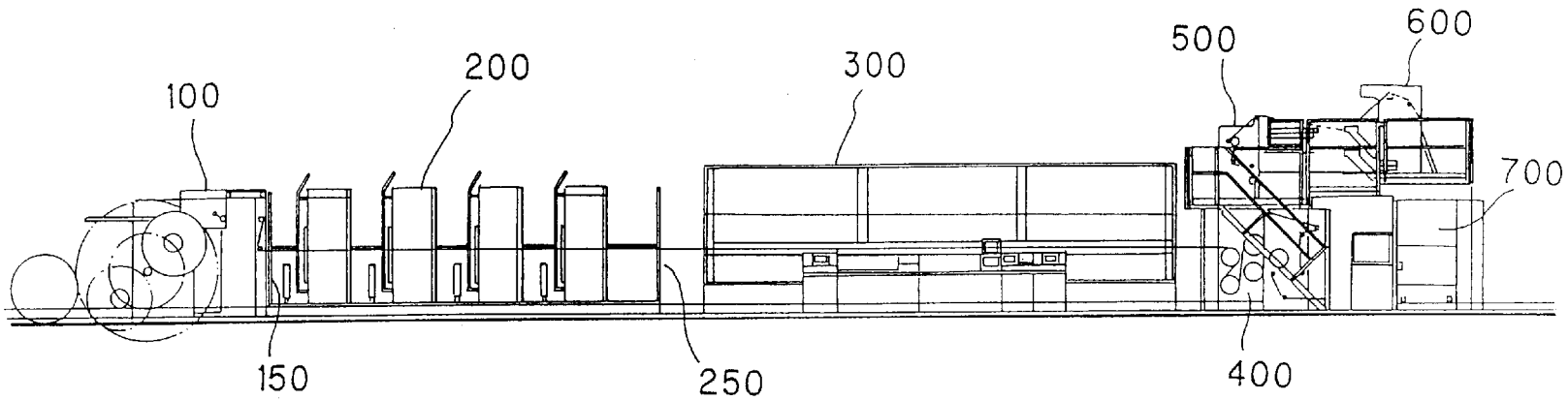
FIG. 1 is the entire schematic view of an offset rotary printing press of an embodiment according to the present invention.

A preferred embodiment of a web offset printing press according to the present invention is shown in FIG. 1.

The web offset printing press as shown in FIG. 1, continuously activates each device so that the previous job can be automatically switched to the next job. The web offset printing press comprises a sheet supply device 100, a plurality of printing units 200, a drying device 300, a cooling device 400, a web passing device 500, a drag device 600, a folding device 700, and so on.

Figure 2:
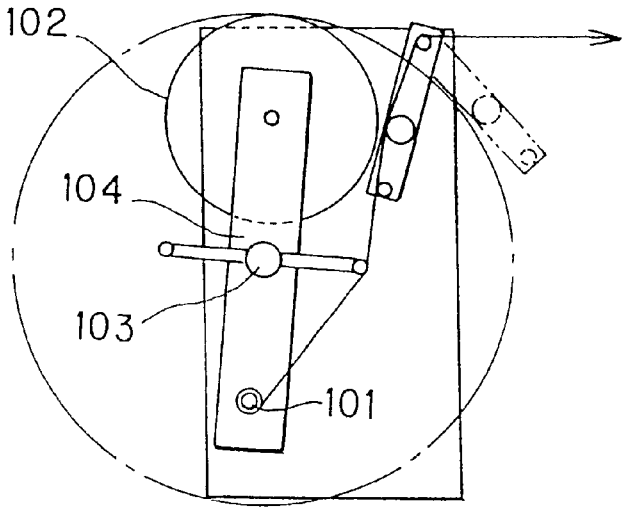
FIG. 2 shows a sheet supply device.

In the sheet supply device as shown in FIG. 2, two web rolls 101 and 102, each wound in a roll form, are attached to the both ends of a turret arm 104, respectively, and the turret arm 104 is pivotally mounted such that the arm 104 is rotatable about a central axis 103. When a web 10 (printing sheet) is rolled out from a web roll 101 and becomes close to an end, a web from the next web roll 102 is jointed and supplied to the printing units 200.

Figure 3:
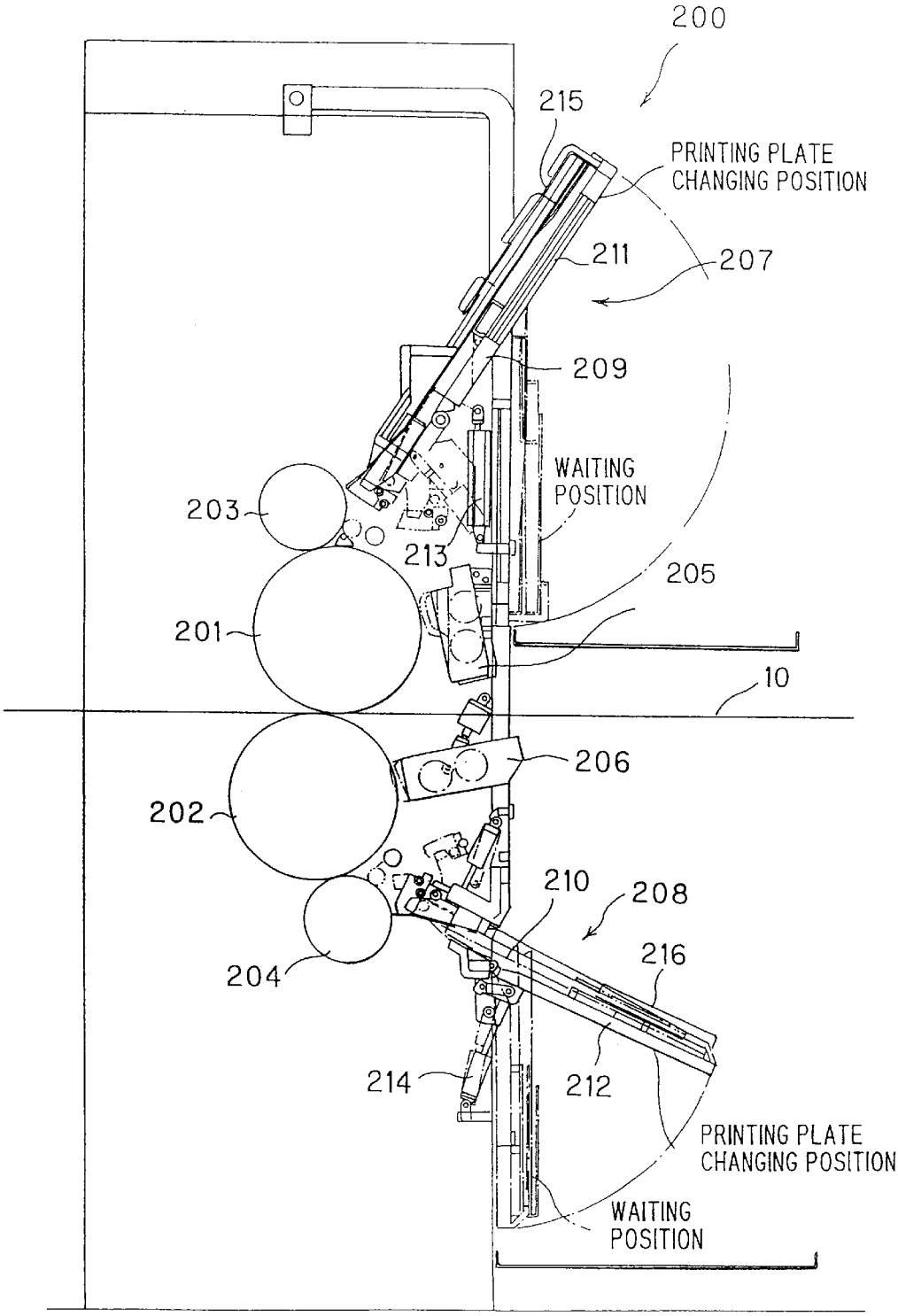
FIG. 3 is a cross sectional view of a printing unit.

In each printing unit 200 as shown in FIG. 3, blanket cylinders 201, 202 and printing cylinders 203, 204 are arranged symmetrically with respect to a horizontal web traveling path. A blanket cleaning device 205 (206) is provided at each blanket cylinder 201 (202) and an automatic printing plate changer (ABC) 207 (208) is provided at the printing cylinder 203 (204).

The upper automatic printing plate changer 207 provides a guide frame 211 rotatable about a supporting axis 209, and an actuator 213 shifts the guide frame 211 from a stand by position to a printing plate changing position as shown in a dotted line. At the guide frame 211, a holder 215 for holding an old printing plate or a new printing plate is provided.

After shifting the guide frame 211 to the printing plate changing position, the old printing plate is released from the printing cylinder 203. By backwardly rotating the printing plate 203, the old printing plate is guided along the guide frame 211 so that the old printing plate can be picked up by extending/shrinking an actuator (not shown).

Then, the new printing plate is supplied to a printing cylinder 203 along the guide frame 211. By forwardly rotating the printing plate 203, the new printing plate is attached to the printing cylinder 203.

Similarly, a lower automatic printing plate changing device 208 provides a guide frame 212 rotatable about a supporting axis 210, and an actuator 214 shifts the guide frame 212 from a stand-by position to a printing plate changing position along a dotted line as shown in the drawing. A holder 216 for holding the old printing plate or the new printing plate is provided at the guide frame 212.

After shifting the guide frame 212 to the printing plate changing position, the old printing plate is disengaged from the printing cylinder 204. By backwardly rotating the printing cylinder 204, the old printing plate is lowered along the guide frame 211.

Then, the new printing plate is supplied to the printing cylinder 204 along the guide frame 212. By forwardly rotating the printing cylinder 204, the new printing plate is attached to the printing cylinder 204.

Figure 4:
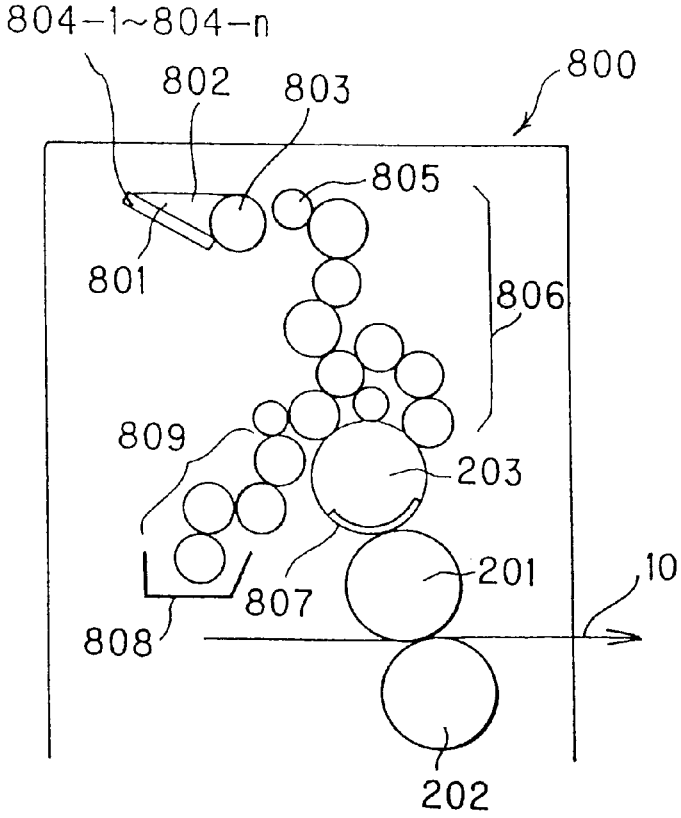
FIG. 4 shows an ink supply device.

Regarding the printing plate mounted on the printing cylinder 203 (204), an ink supplement device 800 is provided as shown in FIG. 4.

The ink supply device 800 supplies ink 802 in an ink fountain 801 on an ink fountain roller 803 by adjusting an open degree of each ink fountains keys 804-1, 801-2, . . . **801-*n*. Ink supplied on the ink fountain roller 803 is transferred to a printing plate 807 through a group of ink rollers 806 by operating an ink ductor roller 805. Simultaneously with such an ink supply operation, dampening water 808 is supplied to the printing plate 807 through a group of dampening rollers 809**.

In the ink supply device 800, when changing the old printing plate 807 to a new printing plate, printing data such as an open degree of the each ink fountain keys 804-1, 804-2, . . . **804-*n* corresponding to a picture pattern of the new printing plate, a rotational amount of the ink fountain roller 803, and a supply amount of dampening water in the dampening water tank 808** is preset as described below.

The blanket cleaning device 205 (206) removes foreign matters such as remained ink and so on by contacting a brush or cloth with the blanket cylinder 201 (202).

A drying machine 300 is a device for heating and drying a printed web 10 fed through the printing units 200. A cooling device 400 is a device for cooling the web 10 passed through the drying machine 300. A web path device 500 is a device for adjusting a passing direction to control a position of a web and its tensile force. A folding device 700 is a device for cutting the web after dry and cool operations and folds each piece of the web 10.

There are a number of types of folding devices based on combinations of cutting and folding the web, such as folding along a central line of the web with respect to a width direction, it is so-called as "former fold", cutting a web having a predetermined length by a cut-off cylinder, folding a cut-off sheet by a folding cylinder along a width direction or a longitudinal direction, it is so called as "parallel fold", and half folding parallel folded sheets by a chopper along an orthogonal direction.

An infeed dancer device 150 is provided between the sheet supply device 100 and the printing units 200, and a final unit dancer device 250 is provided between the printing units 200 and the drying machine 300.

The dancer device 150 (250) winds a web among three rollers, and by moving a central roller in a vertical direction, removes slackness in the web caused by rotation of the printing units 200 in forward/backward directions.

These devices 200 through 700 are connected by on driving axis and driven by a main motor (not shown) mounted at the printing units 200. The main motor can be disconnected from the driving axis by operating a driving clutch provided between the printing units 200 and the final unit dancer device 250.

Figure 5:
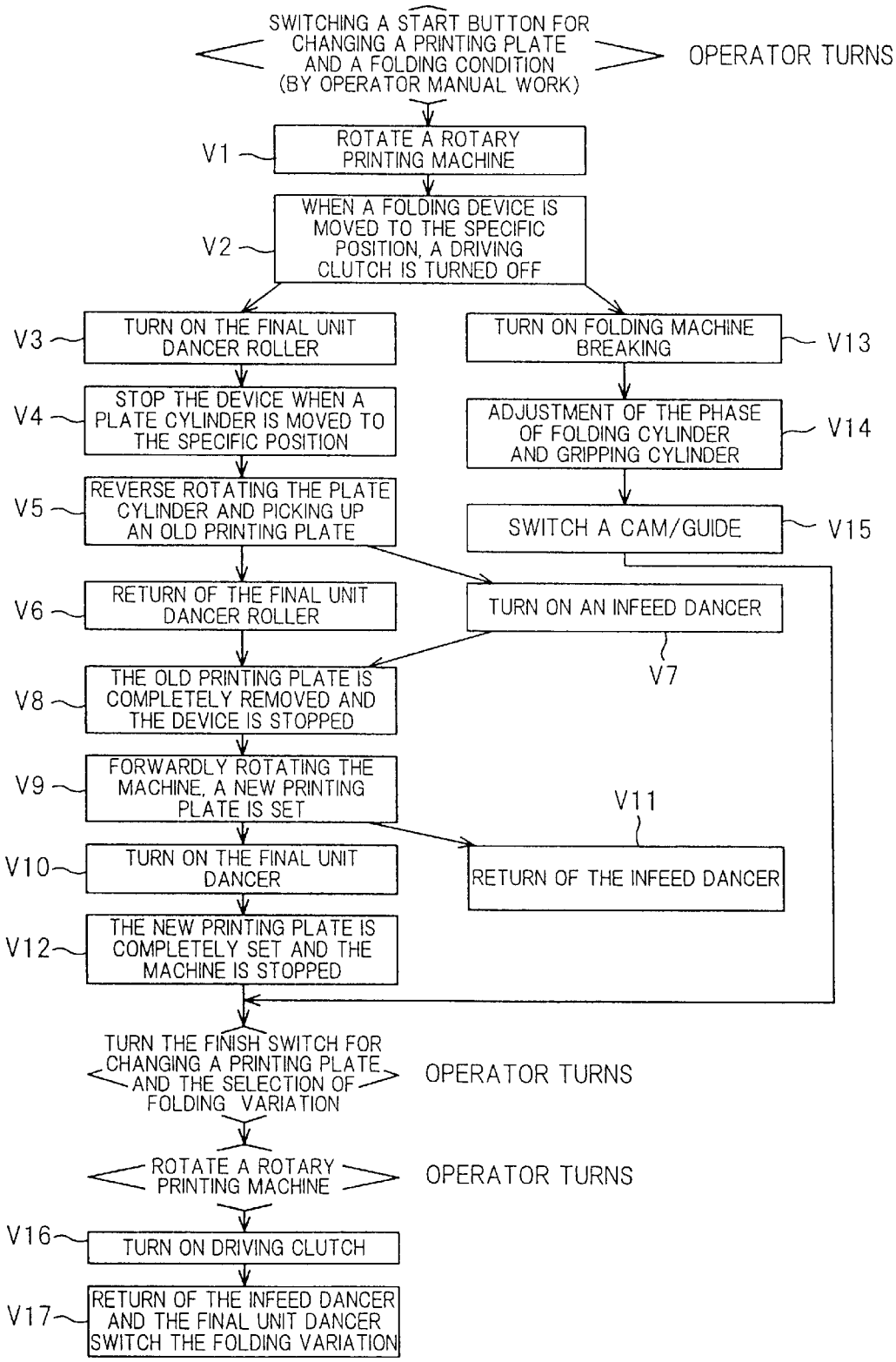
FIG. 5 is a flow-chart for showing a plurality of steps executed by pushing on the switch for APC and the selection of the folding device status.
Figure 8:
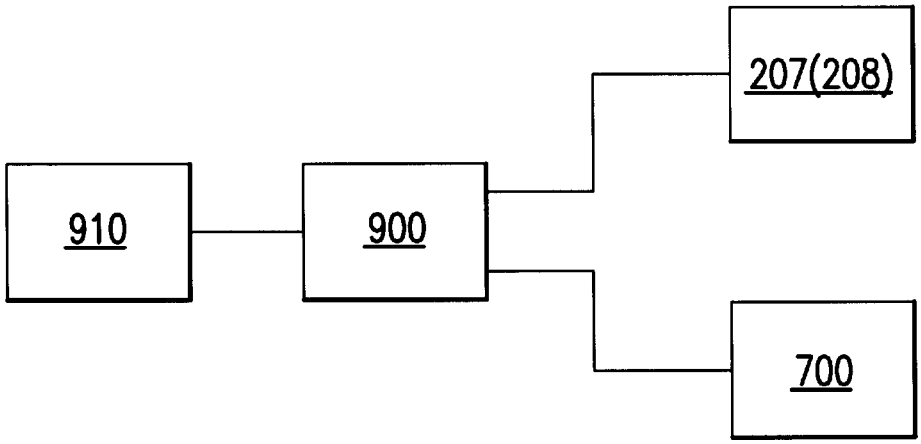
FIG. 8 is a block diagram showing a relationship between a start button, a control device, a printing plate changer, and a folding device.

As shown in FIG. 8, the offset rotary printing press, constructed as described above, is provided with a control device 900 for simultaneously conducting the printing plate change and the folding device status change in accordance with a flow-chart as shown in FIG. 5 by an operator's turning on of a start button 910 for changing a printing plate and a folding device status upon changing a printing job.

Namely, when the start button 910 for changing a printing plate and a folding device status is turned on, the rotary printing press is activated (step V1) and the driving clutch is turned off when the folding cylinder of the folding device 700 has moved to a specific position (step V2).

The reason for turning off the driving clutch is to avoid occurrence of troubles in the folding machine 700, such as the folded sheet falling from the gripping cylinder and the folding cylinder, caused by the reverse rotation in the folding machine 700 for cutting and folding the folded sheet.

Next, the final unit dancer 250 is turned on (step V3) so that a web fed from the printing units 200 to the drying device 300 is prevented from becoming loose by winding the web around a roller moving in up-and-down directions.

Then, when the plate cylinder 203 (204) is moved to a specific position for exchanging the printing plate, the device (the printing units 200 only) is stopped (step V4).

The plate cylinders 203 (204) is rotated in the reverse direction, the old printing plate is removed from the plate cylinder 203 (204) by the automatic printing plate exchanger 207 (208) (step V5).

By rotating the plate cylinder 203 (204) in a reverse direction, a roller of the final unit dancer 250 is returned to the original position (step V6). At the same time, the infeed dancer device 150 is turned on (step V7) in order to avoid the web fed from the printing units 200 to the sheet supply device 100 from loosening.

Thereafter, after finishing removal of the old printing plate, the machine (the printing units 200 only) is stopped (step V8).

Then, the machine (the printing units 200 only) is rotated in the forward direction, the new printing plate is supplied from the automatic printing plate exchanger 207 (208) and attached to the plate cylinder 203 (203) (step V9).

Further, the final unit dancer 250 is turned on (step V10) to prevent the web fed from the printing units 200 to the drying machine 300 from becoming loose. Simultaneously, the roller of the infeed dancer device 150 is returned to the original position (step V11).

When setting of the new printing plate on the plate cylinder 203 (204) has been completed, the machine (the printing units 200 only) is stopped (step V12).

After turning off the driving clutch, a brake of the folding machine is turned on (step V13) to change folding device status simultaneously.

The folding device status is changed by adjusting a phase of the folding cylinder and the gripping cylinder (step V14) and a selection of a cam/guide member (step V15).

An adjustment of the phase of the folding cylinder and the gripping cylinder means to change the phase of a gripping board of the gripping cylinder with respect to a needle and a knife of the folding cylinder corresponding to a single parallel fold or a double parallel fold. For example, as shown in Japanese Patent Publication Kokai 63-282053, the adjustment is made by a gear transmission mechanism.

Switching of the cam/guide member includes cam switching for changing a phase of a cam mechanism for switching an operation timing of a gripping claw, knife, needle and so on provided at a cutting cylinder, a folding cylinder and a gripping cylinder and a guide switching mechanism for changing the single parallel fold, the double parallel fold, and a delta fold.

Figure 6:
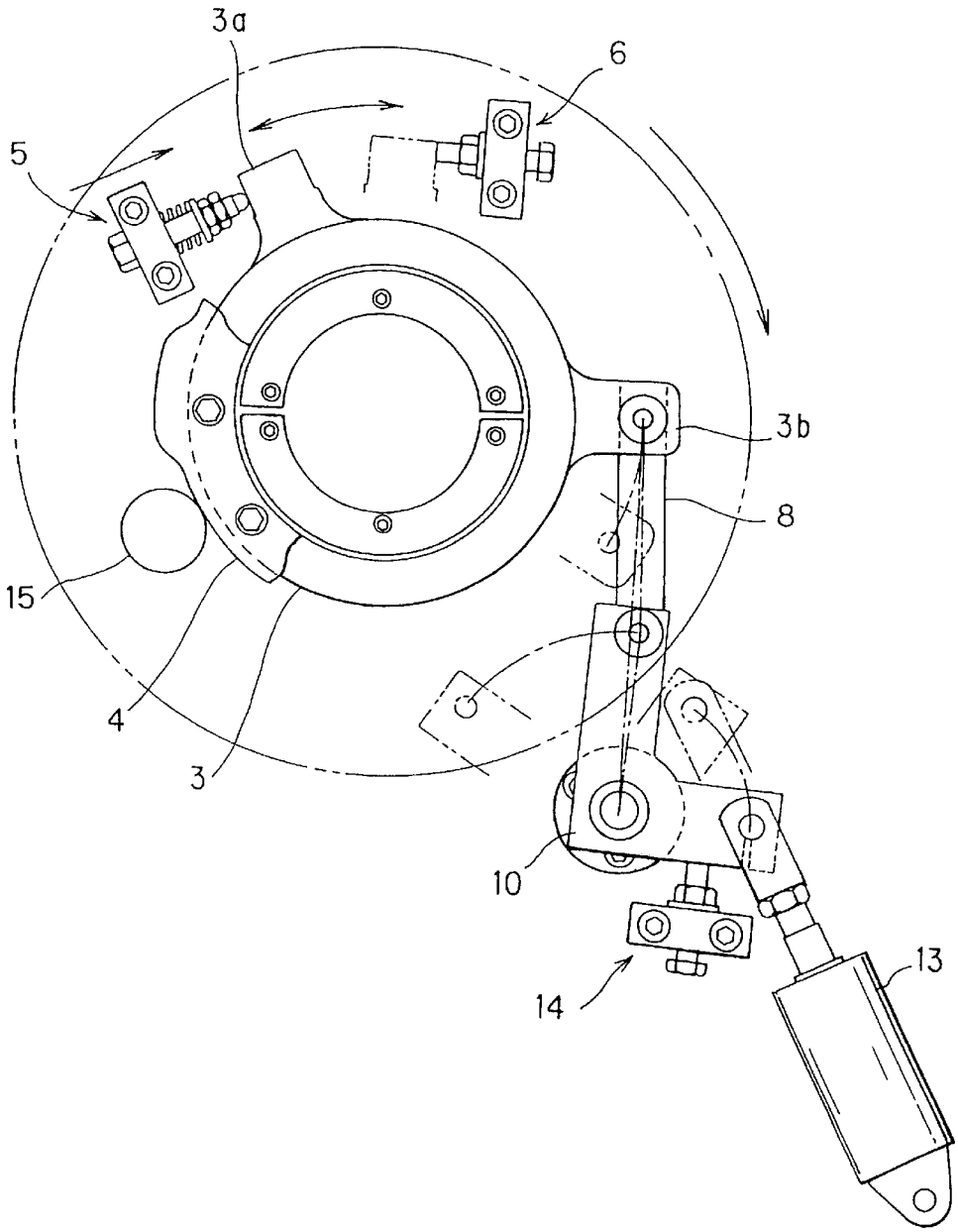
FIG. 6 shows a cam switching operation in a cam mechanism of the present invention.

As shown in FIG. 6, a cam switching mechanism comprises a cam holder 3 rotatably supported and having, on an outer peripheral portion thereof, protrusions 3*a*, 3*b*, a circular cam 4 attached to the cam holder 3 and having a predetermined outer peripheral shape, a cam follower 15 that rolls on the outer peripheral surface of the cam 4, a link plate 8 connected to the protrusion 3*b* of the cam holder 3 and extends and retreats to rotate the cam holder 3, a lever 10, an air cylinder 13, a first stopper 6 for restricting rotation of the cam 4 in one rotating direction caused by the extension the air cylinder 13, a second stopper 14 for restricting rotation of the cam 4 in the opposite rotating direction caused by retraction the air cylinder 13, and a third stopper 5 for urging the protrusion 3*a* of the cam holder 3, restricted from rotating in the opposite direction by the second stopper 14, in the rotating direction restricted by the second stopper 14. The detailed description of the above structure is described in Japanese Patent Publication No. 2000-130538 published on May 12, 2000 based on Japanese Patent Application Hei10-301983 filed on Oct. 23, 1988.

Figure 7:
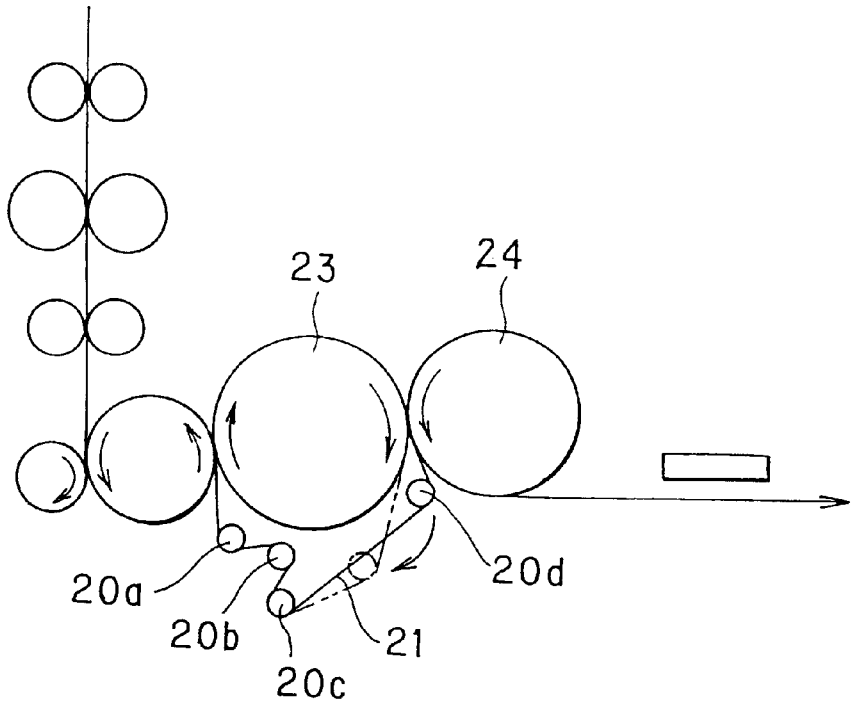
FIG. 7 shows a guide switching operation in a guide mechanism of the present invention.

As the guide switching member, there is a structure as shown in FIG. 7.

The device, as shown in FIG. 7, is a parallel folding device having a first gripping cylinder 23 and a second gripping cylinder 24, the peripheral surfaces of which are in contact with each other. A belt 21 is wound on the first gripping cylinder 23 and rollers 20*a* through 20*d* arranged parallel to the first gripping cylinder 23. The detailed description of the above structure is described in PCT Publication No. WO 01/68496 A1 (PCT/JP00/01597 filed on Mar. 16, 2000) based on Japanese Patent Application No. 10-266166 filed on Sep. 21, 1998.

In the case where a single parallel fold is operated in the device, the roller 20*d* is moved along a solid line in FIG. 7 and the belt 21 is moved to a guiding position.

At the guiding position of the belt 21, a sheet is changed from the first gripping cylinder 23 to the second gripping cylinder 24 to parallel-fold the sheet once.

If the double parallel fold or the delta fold is operated, the roller 20*d* is moved toward an arrow along a dotted line in FIG. 7 and the belt 21 is shifted to a shelter position.

At the shelter position of the belt 21, the double parallel fold or the delta fold is operated when the sheet is passed from the first gripping cylinder 23 to the second gripping cylinder 24.

Upon finishing the above exchange of the printing plates and the selection of folding device status, the driving clutch is turned on (step V16), and the dancer device 150, 250 is returned to the original position (step V17).

Thus, the automatic printing plate change and the switch of the folding device status are accomplished.

As described above, in the embodiment according to the present invention, when the previous job is switched to the next job, each devices 100 through 800 are automatically operated by an operator's pushing of one button so that the total operation time can be shortened and the operator's task/burden becomes lighter.

That is, by actuating a start button for changing a printing plate and a folding device status, an automatic printing plate changing and a folding device status switching can be operated. In addition, the automatic printing plate changing and the folding device status switching are operated in parallel so that the total operation time can be shortened.

In the case that the web 10 is rotated in forward/backward directions during an operation for changing the automatic printing plates, the dancer devices 150, 250 windup the web 10 among three rollers to prevent the web 10 from becoming loose at a portion between the sheet supplement device 100, the printing units 200, and the drying machine 300.

As described above with reference to the embodiment of the present invention, in the device according to the present invention for controlling an automatic printing plate changing and a folding device status switching, the previous job is automatically changed to the new job by pushing one button. The automatic printing plate changing and the folding device status switching are simultaneously operated so that the total operation time can be shortened.

In the operation for changing printing plates, even if the web is rotated in forward/backward directions, the web can be wound such that the web does not become loose at a portion between adjacent devices.

The invention being thus described, it will be obvious that the same may be varied in many ways. Such variations are not to be regarded as a departure from the spirit and scope of the invention, and all such modifications as would be obvious to one skilled in the art arc intended to be included within the scope of the following claims.

What is claimed is:

1. A device for automatically changing a printing plate and switching a folding device status in a web printing press, comprising:

an input unit;

a printing plate changing unit that changes a printing plate supported on a plate cylinder in at least one printing unit;

a folding device status switching unit that switches a folding device status of a folding machine in accordance with a folding device status corresponding to a next printing job;

a dancer device located between a sheet supply device and the folding machine for removing slackness in a web caused by rotation of said plate cylinder in said at least one printing unit; and, a control device that activates said printing plate changing unit and said folding device status switching unit as well as said dancer device in response to an operation of said input unit; and, whereby said printing plate changing unit, said folding device status switching unit and said dancer device operate in parallel so as to reduce total operating time of the printing press when changing from a previous printing job to said next printing job.

2. A device as claimed in claim 1, wherein said printing plate changing unit interrupts an operation of the at least one unit when said plate cylinder is moved to a specific position for changing an old printing plate to a new printing plate, and rotates said plate cylinder in a reverse direction to pick up the old printing plate from said plate cylinder and rotates said plate cylinder in a forward direction to set said new printing plate to said plate cylinder.

3. A device as claimed in claim 1, wherein said folding device status switching unit includes, a cam switch member for switching a phase of a cam mechanism for switching an operation timing of a folding cylinder and a gripping cylinder, and a guide switch member for switching a guide mechanism for selecting one of a single parallel fold, a double parallel fold, and a delta folding.

4. A device as claimed in claim 1, wherein said folding device status switching unit has a cam switch member that includes, a cam holder having protrusions supported on an outer peripheral portion of said cam holder, a circular cam having a predetermined outer peripheral shape attached to said cam holder, a cam follower rolling on said outer peripheral surface of said circular cam, a link plate connected to a protrusion of the cam holder, a first stopper for restricting rotation of said circular cam in one direction caused by extending an air cylinder, a second stopper for restricting rotation of said circular cam in an opposite direction by contracting said air cylinder, and a third stopper for urging said protrusion of said cam holder restricted by the second stopper.

5. A device as claimed in claim 1, wherein said dancer device comprises a final unit dancer device provided between the at least one printing unit and the folding machine for removing slackness in the web caused by the forward rotation of the at least one printing unit.

6. A device as claimed in claim 5 wherein the final unit dancer device removes slackness in the web during a printing plate changing operation.

7. A device as claimed in claim 1, wherein said dancer device comprises an infeed dancer device provided between the sheet supply device and the at least one unit for removing slackness in the web caused by the backward rotation of the at least one printing unit.

8. A device as claimed in claim 7, wherein the infeed dancer device removes slackness in the web during a printing plate changing operation.

9. A device as claimed in claim 1 wherein said dancer device comprises an infeed dancer device provided between the sheet supply device and the at least one unit for removing slackness in the web caused by the backward rotation of the at least one printing unit and a final dancer device provided between the at least one unit and the folding machine for removing slackness in the web caused by the forward rotation of the at least one printing unit.

10. A device as claimed in claim 9 wherein the infeed dancer device and the final dancer device are operated when changing from an old printing plate to a new printing plate.

11. A device as claimed in claim 10 wherein the infeed dancer device and the final dancer device are operated simultaneously when changing from an old printing plate to a new printing plate.

12. A method of controlling an automatic printing plate changing unit and a folding device status switching unit in a web printing press, comprising:

operating an input unit for changing a printing plate and a folding condition;

changing a printing plate supported on a plate cylinder in each of a plurality of printing units in response to said operating step;

switching a folding device status switching unit that switches a folding device status of a folding machine in accordance with a folding device status corresponding to a next printing job and, also activating a dancer device located between a sheet supply device and the folding machine for removing slackness in a web caused by rotation of the plate cylinder in each of the printing units;

said steps of changing, activating and switching occurring in parallel so as to reduce total operation time of the printing press when changing from a previous printing job to said next printing job.

13. A method as claimed in claim 12 wherein the interruption of operation of the printing units occurs when changing from an old printing plate supported on the plate cylinder to a new printing plate.

14. A method as claimed in claim 12, wherein the step of activating a dancer device comprises activating a final unit dancer device located between the printing units and the folding machine for removing slackness in the web caused by the forward rotation of the printing units upon during a printing plate changing operation in parallel with said switching step.

15. A method as claimed in claim 12, wherein the step of activating a dancer device comprises activating an infeed dancer device located between the sheet supply device and the printing units for removing slackness in the web caused by the backward rotation of the printing units during a printing plate changing operation in parallel with said switching step.

16. A method as claimed in claim 12 wherein the step of activating a dancer device comprises activating an infeed dancer device located between the sheet supply device and the printing units for removing slackness in the web caused by the backward rotation of the printing units and activating a final unit dancer device between the printing units and the folding machine for removing slackness in the web caused by the forward rotation of the printing units in parallel with said switching step when changing from an old printing plate to a new printing plate.

17. A method as claimed in claim 16 wherein the infeed dancer device and the final dancer device are activated simultaneously when changing from an old printing plate to a new printing plate.

* * * * *